US008689694B2

(12) United States Patent
Haumann et al.

(10) Patent No.: US 8,689,694 B2
(45) Date of Patent: Apr. 8, 2014

(54) FLYING BOMB

(75) Inventors: Juergen Haumann, Boppard (DE); Martin Clifford Bucksch, Ruppichteroth (DE)

(73) Assignee: Diehl BGT Defence GmbH & Co. KG, Ueberlingen (DE)

( * ) Notice: Subject to any disclaimer, the term of this patent is extended or adjusted under 35 U.S.C. 154(b) by 2 days.

(21) Appl. No.: 13/463,988

(22) Filed: May 4, 2012

(65) Prior Publication Data

US 2012/0291651 A1 Nov. 22, 2012

Related U.S. Application Data

(63) Continuation of application No. PCT/EP2009/007887, filed on Nov. 4, 2009.

(51) Int. Cl.
*F42B 12/06* (2006.01)
*F42B 12/16* (2006.01)

(52) U.S. Cl.
USPC ..... 102/384; 102/518

(58) Field of Classification Search
USPC ..... 102/382, 384, 385, 393, 473, 489, 517, 102/518
See application file for complete search history.

(56) References Cited

U.S. PATENT DOCUMENTS

| | | | | |
|---|---|---|---|---|
| 4,075,946 | A | 2/1978 | Deffayet et al. | |
| 5,656,792 | A * | 8/1997 | Rentzsch et al. | 102/489 |
| 5,939,662 | A | 8/1999 | Bootes et al. | |
| 6,276,277 | B1 * | 8/2001 | Schmacker | 102/384 |
| 6,374,744 | B1 * | 4/2002 | Schmacker et al. | 102/518 |
| 6,389,977 | B1 | 5/2002 | Schmacker et al. | |
| 6,408,762 | B1 | 6/2002 | Schmacker et al. | |
| 6,883,435 | B1 | 4/2005 | Schildknecht et al. | |
| 7,644,663 | B2 * | 1/2010 | Illesi | 102/498 |
| 7,878,121 | B2 * | 2/2011 | Salignon et al. | 102/489 |
| 7,886,668 | B2 | 2/2011 | Hugus et al. | |
| 8,151,712 | B2 * | 4/2012 | Salignon et al. | 102/522 |

FOREIGN PATENT DOCUMENTS

| | | | |
|---|---|---|---|
| DE | 2703638 | A1 | 8/1977 |
| DE | 19535218 | C1 | 2/1997 |
| DE | 19600167 | C1 | 7/2003 |
| DE | 69811343 | T2 | 11/2003 |
| DE | 697 30 252 | T2 | 12/2004 |
| EP | 1 038 152 | B1 | 8/2004 |
| EP | 1 864 960 | A2 | 12/2007 |
| WO | 2008/096069 | A1 | 8/2008 |

OTHER PUBLICATIONS

International Search Report of PCT/EP2009/007887, Dated Jul. 14, 2010.

* cited by examiner

*Primary Examiner* — James Bergin
(74) *Attorney, Agent, or Firm* — Laurence A. Greenberg; Werner H. Stemer; Ralph E. Locher

(57) ABSTRACT

A flying bomb includes a standardized bomb casing formed of steel and having a nose opening and a tail opening. A thin penetrator is disposed in the bomb casing in order to achieve high effectiveness with little collateral damage when the flying bomb strikes a target. A distance between the tip of the penetrator and the nose opening is greater than 100 mm.

15 Claims, 2 Drawing Sheets

FLYING BOMB

CROSS-REFERENCE TO RELATED APPLICATION

This is a continuation, under 35 U.S.C. §120, of copending International Application No. PCT/EP2009/007887, filed Nov. 4, 2009, which designated the United States; the prior application is herewith incorporated by reference in its entirety.

BACKGROUND OF THE INVENTION

Field of the Invention

The invention relates to a flying bomb. Flying bombs are stored without fittings, such as a fuse, wind impeller generator, electrical connecting cable, steering devices and suspension eyes. The fittings are fitted immediately before use, and the flying bomb is made ready for operation. In this application, the expression flying bomb relates primarily to the storage state, in which the above-mentioned fittings have not yet been fitted.

New developments in flying bombs and their integration in possible platforms are extremely complex. One possible way to reduce the costs involved therein is to make use of existing systems. The external dimensions, the mass, the center of gravity position and the mass moments of inertia about the spatial axes are known for existing systems. Those parameters govern the aerodynamic characteristics. Furthermore, suspension points are present for attachment to a carrier platform. Finally, mechanical interfaces are known, for example, in order to fit steering devices.

German Translation DE 697 30 252 T2 of European Patent EP 1 038 152 B1, corresponding to U.S. Pat. Nos. 6,389,977 and 6,408,762, disclose a flying bomb which has been developed further. That flying bomb is based on a known explosive bomb. The flying bomb which has been developed further has a casing with external dimensions that correspond precisely to those of the known explosive bomb. The mass characteristics likewise correspond to those of the known explosive bomb. A penetrator is disposed within the casing, and has an explosive charge in the tail. A standardized bomb casing often weighs more than one third of the total mass of a flying bomb, and is therefore not used therein. In fact, the casing is a newly developed lightweight component, in order to make it possible to provide a greater mass for the penetrator, and therefore greater effectiveness.

One flying bomb of that generic type is the BLU-126/B flying bomb. The BLU-126/B has the following features:

- the flying bomb has a standardized bomb casing,
- the bomb casing is the bomb casing of the MK 82 flying bomb,
- the bomb casing is formed of steel,
- the bomb casing has a relatively small nose opening and a relatively large tail opening.

The flying bomb, such as the Mark 82 (or MK 82), which is an unguided, low-drag general-purpose bomb with a streamlined steel casing, is described on the Internet at http://en.wikipedia.org/wiki/Mark_82_bomb, Mar. 25, 2012.

The BLU-126/B flying bomb represents a variant of the MK 82. The MK 82 is the most widely used explosive bomb in the U.S. and NATO armed forces. The BLU-126/B flying bomb was constructed in accordance with a requirement from the United States Navy for a bomb with reduced collateral damage for attacks from the air. It is also known as the "Low Collateral Damage Bomb (LCDB)," In order to achieve less collateral damage, the BLU-126/B has a relatively small explosive charge. However, a non-explosive filling is added in order to keep the same mass as before. That means that the aerodynamic characteristics of the bombs remain the same.

SUMMARY OF THE INVENTION

It is accordingly an object of the invention to provide a flying bomb, which overcomes the hereinafore-mentioned disadvantages of the heretofore-known devices of this general type and which uses a standardized bomb casing formed of steel, which is highly effective, with little collateral damage, when it strikes a target.

With the foregoing and other objects in view there is provided, in accordance with the invention, a flying bomb, comprising a standardized bomb casing of an MK 81, 82, 83 or 84 flying bomb. The bomb casing is formed of steel and has a front nose opening and a tail opening. A thin penetrator is disposed in the bomb casing. The penetrator has a front tip spaced apart from the front nose opening by a distance greater than 100 mm.

As mentioned above, the flying bomb has a standardized bomb casing and the bomb casing is, in particular, the bomb casing from the MK 81, 82, 83 or 84 flying bombs. Such bomb casings are available in large quantities. The use of those bomb casings reduces costs. Furthermore, a multiplicity of fittings which have already been completely developed and tested, and can be made use of, are available for those bomb casings. That also reduces the costs. The bomb casing is formed of steel and has a nose opening and a tail opening. These are the constraints for a thin penetrator which is disposed in the bomb casing. The bomb casing, which is constructed for an explosive bomb, is now used as a bomb casing for a penetrator. Since the distance between the tip of the penetrator and the nose opening is greater than 100 mm, a very much greater penetration of the penetrator is achieved than expected. This is achieved in that the bomb casing formed of steel causes initial damage to the target. The initial damage to the target allows the penetrator to penetrate considerably more deeply into the target. The highly mechanically robust bomb casing formed of steel is used in order to weaken the target and to make it easier for the following penetrator to pass through the target. Since the penetrator is thin, its mass is concentrated in a small cross-sectional area. For the same kinetic energy, a smaller cross-sectional area leads to greater penetration performance. Since the bomb casing always makes contact with the target before the penetrator, the penetration behavior of the penetrator is also assisted at different angles of incidence.

In particular, a penetrator can be considered to be thin if it has a length which is more than 7 times as great as its maximum external diameter.

In accordance with another feature of the invention, the distance between the tip of the penetrator and the nose opening is less that 500 mm. This means that the penetrator is sufficiently long to ensure high effectiveness in the target.

In accordance with a further feature of the invention, the distance between the tail end of the penetrator and the tail end of the bomb casing is less than 50 mm. This measure also ensures a sufficient length of the penetrator, linked to high effectiveness in the target.

In accordance with an added feature of the invention, the mass of the penetrator corresponds substantially to the mass of the explosive charge which is used in the flying bomb, which is in the form of an explosive bomb. This measure means that the penetrator has as great a mass as possible. The penetrator virtually completely replaces the previous explosive charge.

In accordance with an additional feature of the invention, the maximum cross-sectional area of the penetrator is less than the cross-sectional area of the tail opening in the bomb casing. This makes it easier to install the penetrator in the bomb casing. During assembly, the penetrator can be introduced into the bomb casing through the tail opening.

In accordance with yet another feature of the invention, the maximum cross-sectional area of the penetrator is greater than the cross-sectional area of the nose opening. This measure on one hand results in a disadvantage in that the penetrator has to widen the relatively narrow nose opening in the bomb casing. However, that is outweighed by the advantages resulting from the penetrator having the maximum possible mass, subject to the existing constraints, which are also discussed in the exemplary embodiment.

In accordance with yet a further feature of the invention, the penetrator has an explosive charge disposed in the tail. The explosive charge can be fired at the time of striking the target, or with a time delay. The explosive charge is intended to achieve a locally limited effect. The aim is to avoid collateral damage.

In accordance with yet an added feature of the invention, the proportion of the mass of the explosive charge to the total mass of the penetrator is at most 20%. The major aspect of the effect is therefore placed on penetration, with the effect of the penetrator fragments and the fragments of the bomb casing being limited, because of the very small explosive charge.

In accordance with yet an additional feature of the invention, a fuse holding socket is disposed in the explosive charge of the penetrator and has the same dimensions as the fuse holding socket in the explosive bomb. This means simple handling for a member of the armed forces. In order to make the bomb ready for operation, he or she must insert the fuse into the fuse holding socket in the same way as in the previous explosive bomb.

In accordance with again another feature of the invention, the bomb casing has a holding socket for a wind impeller generator, and a cable channel is disposed in the penetrator and runs from the fuse holding socket to a bottom opening in the holding socket of the wind impeller generator. In order to make the bomb ready for operation, a connecting cable must be laid in the cable channel, and a wind impeller generator must be fitted, in precisely the same way as for the previous explosive bomb.

In accordance with again an added feature of the invention, the penetrator is fixed in the bomb casing by a fixing device. The fixing device fixes the position of the penetrator during storage, transport and during use, until the bomb strikes the target.

In accordance with again an additional feature of the invention, the fixing device is installation foam. This represents a cost-effective measure. The mass of the installation foam is insignificant in comparison to the total mass.

In accordance with a concomitant feature of the invention, the standardized bomb casing has mechanical interfaces through which steering devices can be mounted in front of an insert. Existing, standardized steering devices from the previous explosive bomb can be used.

Other features which are considered as characteristic for the invention are set forth in the appended claims.

Although the invention is illustrated and described herein as embodied in a flying bomb, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
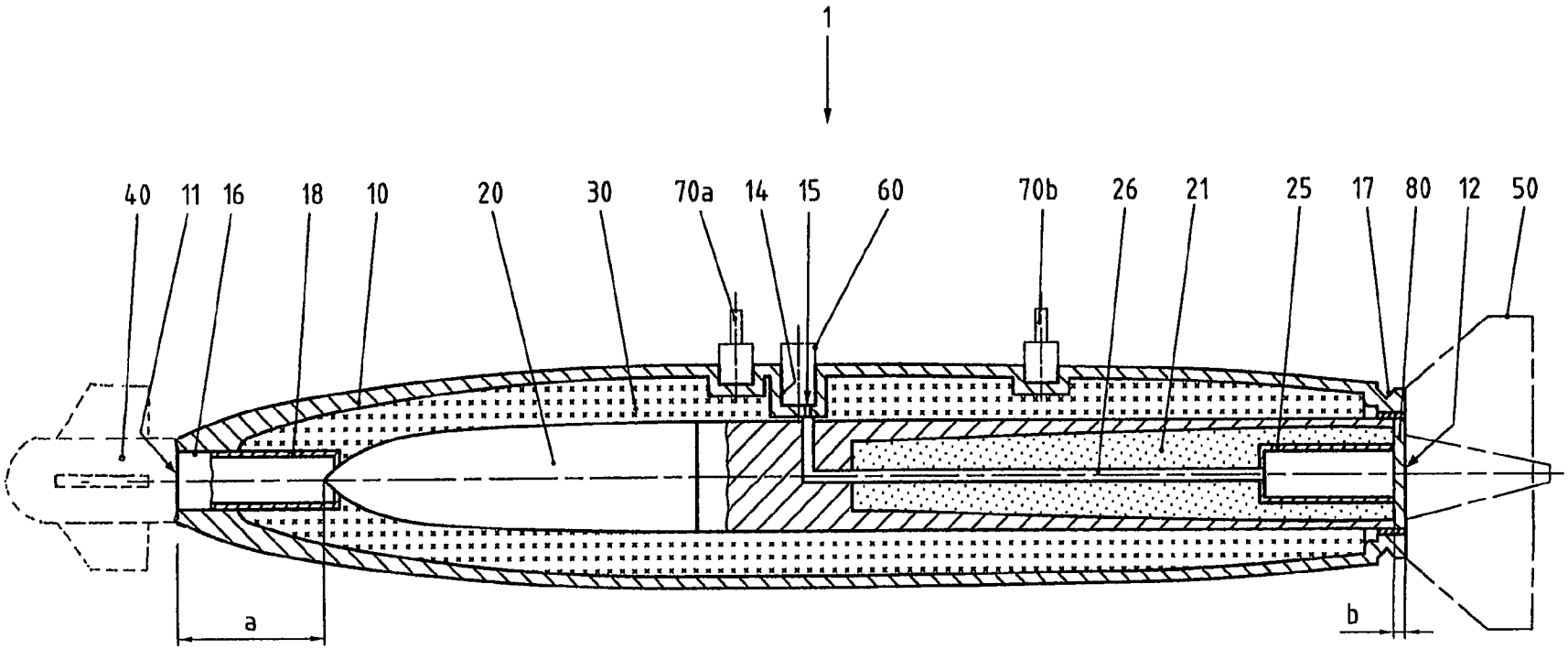
FIG. 1 is a diagrammatic, longitudinal-sectional view of a flying bomb with a penetrator.

Referring now to the figures of the drawings in detail and first, particularly, to FIG. 1 thereof, there is seen a flying or aerial bomb 1. The flying bomb 1 has a standardized bomb casing 10. The bomb casing 10 is the bomb casing of the original or MK 82 flying bomb. In contrast thereto, the bomb casing may also be the bomb casing of the smaller MK 81 flying bomb, or the larger MK 83 or 84 flying bombs. The MK-type flying bombs are explosive bombs. The bomb casing 10 is formed of steel and has a relatively small nose opening 11 and a relatively large tail opening 12. In contrast to the configuration of an explosive bomb, in which the bomb casing is filled with explosive, a thin penetrator 20 is now disposed in the bomb casing 10.

Figure 2A:
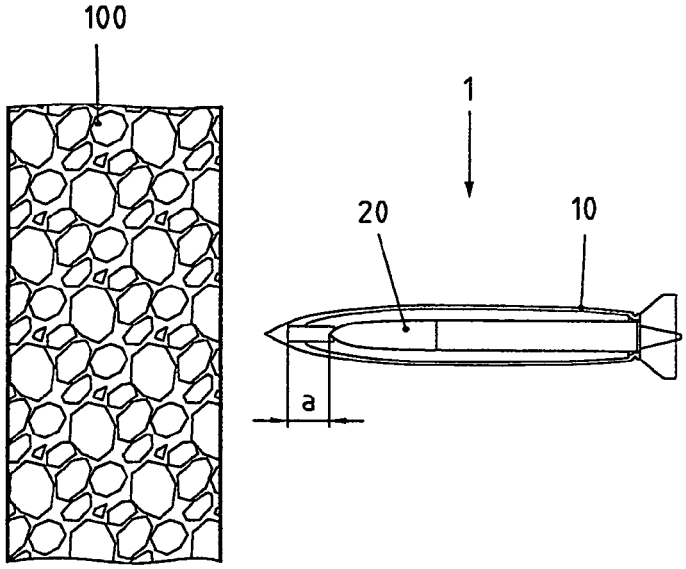
FIGS. 2A to 2C are side-elevational views, on a reduced scale, showing individual steps of penetrating a target and illustrating an effect mechanism.
Figure 2B:
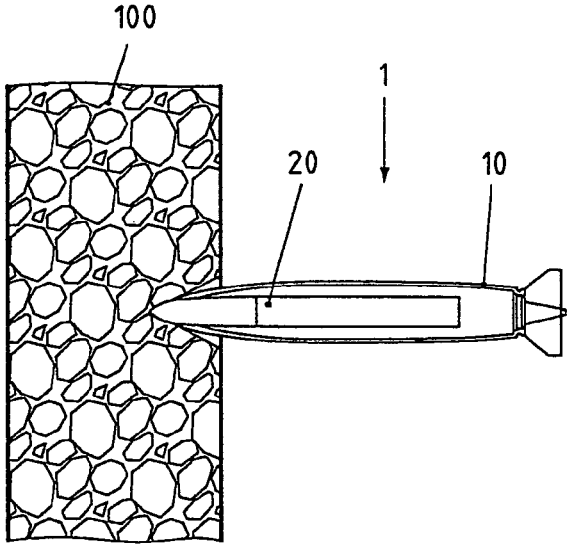
Figure 2C:
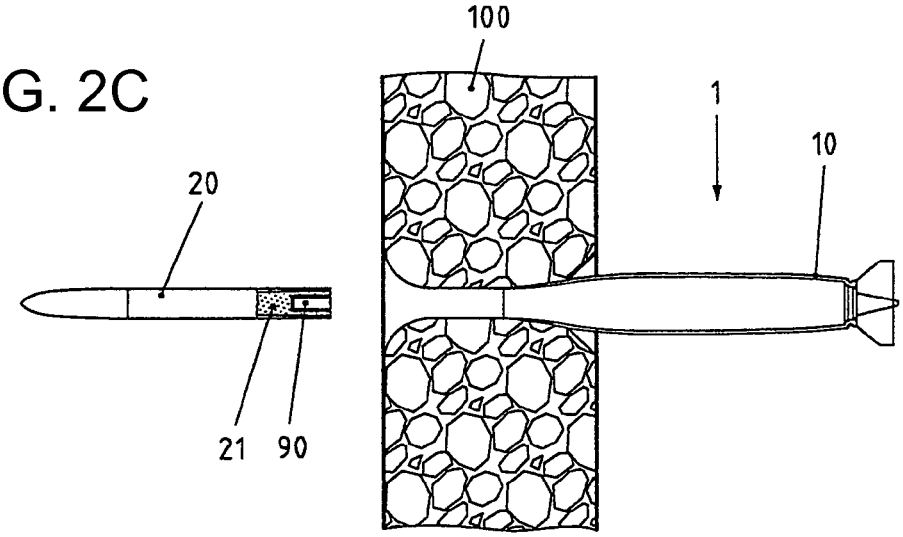

The method of operation of the flying bomb 1 is illustrated in FIGS. 2A to 2C. FIG. 2A shows a flying bomb shortly before striking a target 100. The target 100 is a concrete target. The speed of the flying bomb is about 250 m/s. The bomb casing 10 and the penetrator 20 are initially moving at the same speed. A distance a between the tip of the penetrator 20 and the nose opening is greater than 100 mm, preferably greater than 150 mm. The distance a is likewise shown in the enlarged illustration of the flying bomb in FIG. 1. This distance a importantly ensures that the bomb casing 10 still strikes the target before the tip of the penetrator. As is shown in FIG. 2B, initial damage takes place in the target, caused substantially by the structural strength of the bomb casing, and making it considerably easier for the following penetrator to penetrate the target.

The total mass of the flying bomb with a penetrator shown in FIG. 1 is also about 213 kg, which is the same as the original explosive bomb. The mass relates to the storage state, in which fittings have not yet been fitted. The same, standardized fittings can be used for the flying bomb 1 which is illustrated in FIG. 1 with a penetrator 20, as are used for the original explosive bomb. The fittings are:

- a non-illustrated fuse, which occupies a space in a fuse holding socket 25,
- a wind impeller generator 60 in the holding socket 14,
- a non-illustrated electrical connecting cable, which is mounted in a cable channel 26,
- a front steering device 40, which may have a seeker head and is attached through a mechanical interface 16,
- a rear steering device 50, which has a fin assembly with steering wings and is held by a mechanical interface 17, and
- suspension eyes 70*a* and 70*b* for fitting to a carrier platform.

The original explosive bomb contains a mass of about 90 kg of explosive. The mass of the penetrator 20 corresponds to the mass of the explosive charge which was used in the flying bomb which is in the form of an explosive bomb. The mass of the penetrator is accordingly about 90 kg.

The mass of the bomb casing 10 is about 120 kg. A mass of about 3 kg therefore remains for further attachment parts, for example for a front spacer socket 18 and a cover 80.

The penetrator 20 is fixed in the bomb casing 10 by a fixing device. The fixing device is installation foam 30, which has a mass that is so small that it can be ignored when configuring the mass of the penetrator 20. The spacer socket 18 centers the penetrator and simplifies assembly. The distance a between the tip of the penetrator 20 and the nose opening 11 in the bomb casing 10 should preferably be chosen to be so great that the nose fuse housing, which is provided in the standardized bomb casing and is slightly modified, can be installed as the spacer socket 18. The slight modification relates to centering of the penetrator tip.

The round tail opening 12 in the bomb casing 10 has a diameter of 150 mm. The maximum external diameter of the penetrator 20 is less, and is about 140 mm, in order to allow it to be installed through the tail opening 12.

In the present exemplary embodiment, in which the standardized bomb casing of the MK 82 explosive bomb is used, the maximum cross-sectional area of the penetrator 20, with a diameter of about 140 mm, is greater than the cross-sectional area of the nose opening 11, with a diameter of about 80 mm. This is a result of predetermined constraints, which means that the physical characteristics of the standard explosive bomb must not be modified.

When using the MK 81, MK 83 or MK 84 bomb casing, as well, the maximum cross-sectional area of the penetrator is still greater than the cross-sectional area of the nose opening.

Investigations have shown that the conical tip of the penetrator can tear the opening in the robust bomb casing without any problems. The losses in overcoming the radial structural strength of the front, robust ring cross section are less than expected.

As is illustrated with reference to FIGS. 2A to 2C, the minimum distance a is provided on one hand in order to ensure that the bomb casing causes initial damage to the target when it strikes. On the other hand, penetrators are made as thin as possible, to provide a great effect on the target. The distance a between the tip of the penetrator 20 and the nose opening 11 is therefore less than 500 mm, and preferably less than 300 mm. For the same reason, a distance b between the tail end of the penetrator and the tail end of the bomb casing 10 is less than 50 mm. In the exemplary embodiment, the distance b corresponds to the thickness of the bottom of the cover 80 which is fitted to the tail.

The penetrator 20 has an explosive charge 21 disposed in the tail. The proportion of the mass of the explosive charge 21 to the total mass of the penetrator 20 is at most 20%. In the exemplary embodiment, the explosive charge 21 has a mass of about 10 kg.

The fuse holding socket 25 is disposed in the penetrator charge 21 and has the same dimensions as the fuse holding socket used in the explosive bomb having the bomb casing which has been transferred to the present invention. FIG. 2C shows the fuse 90 installed in the flying bomb. The time at which the fuse 90 is fired can be set, for example, from a carrier aircraft. The firing time can either coincide with the impact time, or may be delayed by a time delay after the impact time. FIG. 2C shows the penetrator in a position which is suitable for firing the small explosive charge 21.

The standardized bomb casing 10 has the holding socket 14 for a wind impeller generator. The cable channel 26 is disposed in the penetrator 20, and runs from the fuse holding socket 25 to a bottom opening 15 in the holding socket 14 of the wind impeller generator.

The standardized bomb casing has the nose mechanical interface 16 and the tail mechanical interface 17. The nose steering device 40 or the tail steering device 50 can be fitted immediately before use. The nose steering device 40 may contain a seeker head. The tail steering device may have a fin assembly, with variable wings.

The invention claimed is:

1. A flying bomb, comprising:

a standardized bomb casing of an MK 80 series flying bomb, said bomb casing formed of steel and having a front nose opening and a tail opening; and a penetrator disposed in said bomb casing, said penetrator having a front tip spaced apart from said front nose opening by a distance greater than 100 mm and said penetrator having a maximum external diameter and a length being greater than said maximum external diameter.

2. The flying bomb according to claim 1, wherein said bomb casing of an MK 80 series flying bomb is a bomb casing of an MK 81, 82 , 83 or 84 flying bomb.

3. The flying bomb according to claim 1, wherein said distance between said front tip of said penetrator and said front nose opening is less than 500 mm.

4. The flying bomb according to claim 1, wherein said bomb casing has a tail end, and said penetrator has a tail end spaced apart from said tail end of said bomb casing by a distance of less than 50 mm.

5. The flying bomb according to claim 1, wherein said penetrator has a mass corresponding substantially to a mass of an explosive charge used in an explosive flying bomb.

6. The flying bomb according to claim 1, wherein said penetrator has a maximum cross-sectional area being less than a cross-sectional area of said tail opening in said bomb casing.

7. The flying bomb according to claim 1, wherein said penetrator has a maximum cross-sectional area being greater than a cross-sectional area of said front nose opening.

8. The flying bomb according to claim 1, wherein said penetrator has a tail and an explosive charge disposed in said tail.

9. The flying bomb according to claim 8, wherein the proportion of the mass of said explosive charge to the total mass of said penetrator is at most 20%.

10. The flying bomb according to claim 8, which further comprises a standardized fuse holding socket disposed in said explosive charge.

11. The flying bomb according to claim 10, wherein:

said bomb casing has a holding socket for a wind impeller generator; and said penetrator has a cable channel disposed therein and running from said fuse holding socket to a bottom opening in said holding socket for the wind impeller generator.

12. The flying bomb according to claim 1, which further comprises a fixing device fixing said penetrator in said bomb casing.

13. The flying bomb according to claim 12, wherein said fixing device is installation foam.

14. The flying bomb according to claim 1, wherein said bomb casing has mechanical interfaces for mounting steering devices in front of an insert.

15. The flying bomb according to claim 1, wherein said length of said penetrator is more than seven times as great as said maximum external diameter of said penetrator.

* * * * *